US010266969B2

(12) United States Patent
Fisher

(10) Patent No.: US 10,266,969 B2
(45) Date of Patent: Apr. 23, 2019

(54) ANTIMICROBIAL AND WICKING MATERIALS AND METHODS OF MAKING THE SAME

(71) Applicant: Gidon Fisher, Thornhill (CA)

(72) Inventor: Gidon Fisher, Thornhill (CA)

( * ) Notice: Subject to any disclaimer, the term of this patent is extended or adjusted under 35 U.S.C. 154(b) by 237 days.

(21) Appl. No.: 15/159,985

(22) Filed: May 20, 2016

(65) Prior Publication Data

US 2016/0340809 A1 Nov. 24, 2016

Related U.S. Application Data

(60) Provisional application No. 62/164,904, filed on May 21, 2015.

(51) Int. Cl.
*D02G 3/04* (2006.01)
*D04B 1/16* (2006.01)

(52) U.S. Cl.
CPC ..... *D02G 3/045* (2013.01); *D04B 1/16* (2013.01); *D10B 2331/02* (2013.01); *D10B 2401/13* (2013.01); *D10B 2509/028* (2013.01)

(58) Field of Classification Search
CPC .... D02G 3/045; D04B 1/16; D10B 2331/021; D10B 2331/04; D10B 2401/13; D10B 2509/028; Y10T 428/2922; Y10T 428/2927; Y10T 442/2525; Y10T 442/2533; Y10T 442/2541
USPC ..... 264/173.15
See application file for complete search history.

(56) References Cited

U.S. PATENT DOCUMENTS

| | | | | |
|---|---|---|---|---|
| 3,461,695 | A * | 8/1969 | Knohl | D04B 1/24 66/178 A |
| 4,784,909 | A * | 11/1988 | Emi | A46D 1/00 428/357 |
| 2004/0247653 | A1* | 12/2004 | Gabbay | A01N 57/00 424/443 |
| 2005/0027219 | A1* | 2/2005 | Schultze | A61F 13/041 602/3 |
| 2005/0176324 | A1* | 8/2005 | Michel | A41B 11/00 442/304 |
| 2006/0099866 | A1* | 5/2006 | Leonard | A01N 25/34 442/181 |

(Continued)

FOREIGN PATENT DOCUMENTS

| | | |
|---|---|---|
| CN | 101701370 | 5/2010 |
| DE | 12007003648 | 7/2008 |

(Continued)

OTHER PUBLICATIONS

Theivasanthi, T. "Nano sized copper particles by electrolytic synthesis and characterizations" International Journal of the Physical Sciences, vol. 6(15), pp. 3662-3671, Aug. 4, 2011, online at http://www.academicjournals.org/IJPS (Year: 2011).*

*Primary Examiner* — Jennifer A Steele
(74) *Attorney, Agent, or Firm* — Phillips Lytle LLP; David L. Principe

(57) ABSTRACT

A method of making a yarn is disclosed. A plurality of fibers is obtained by: preparing a slurry of polymer mixed with water insoluble nanoparticles of electrolytic copper, and extruding the slurry through a spinneret that includes a plurality of holes which impart a generally "X"-shaped cross-section to the plurality of fibers. The plurality of fibers are spun together to form the yarn.

5 Claims, 2 Drawing Sheets

(56) References Cited

U.S. PATENT DOCUMENTS

| | | | | |
|---|---|---|---|---|
| 2008/0038981 | A1* | 2/2008 | Hanes | D04H 13/00 442/380 |
| 2009/0019624 | A1* | 1/2009 | Birk | A62B 17/00 2/455 |
| 2009/0130160 | A1* | 5/2009 | Dugan | A61K 9/00 424/407 |
| 2010/0005568 | A1* | 1/2010 | Smith | A41B 11/00 2/240 |
| 2015/0292125 | A1* | 10/2015 | Yoshida | D02G 3/22 139/420 R |

FOREIGN PATENT DOCUMENTS

| | | |
|---|---|---|
| WO | WO01/74166 | 10/2001 |
| WO | WO03/035973 | 5/2003 |
| WO | WO2006/100665 | 9/2006 |
| WO | WO2009/026531 | 2/2009 |

* cited by examiner

ANTIMICROBIAL AND WICKING MATERIALS AND METHODS OF MAKING THE SAME

TECHNICAL FIELD

The present disclosure relates to antimicrobial materials and, in particular, to antimicrobial polymer yarns and methods of making the same.

BACKGROUND

Garments which have antimicrobial properties are beneficial. Damp and sweaty clothing may be conducive to bacterial growth, which can cause odor and lead to skin irritation or infection. Various metals have been used as antimicrobial agents to inhibit or reduce the ability of bacteria to grow in fabric. In particular, copper and its alloys have been used to enhance antimicrobial properties of fabric used in garments. For example, U.S. Pat. No. 6,602,811 describes a composite textile fabric which has a fabric layer that is treated by applying a paste or coating having antimicrobial properties (e.g. ionic copper or silver). Coatings of antimicrobial agents may not be effective in providing long-term prevention of bacterial growth, since the antimicrobial activity of the agents may be gradually lost over time as the garments are laundered.

BRIEF DESCRIPTION OF DRAWINGS

Reference will now be made, by way of example, to the accompanying drawings which show example embodiments of the present application and in which.

Like reference numerals are used in the drawings to denote like elements and features.

DETAILED DESCRIPTION OF EXAMPLE EMBODIMENTS

In an aspect, the present disclosure describes a method of making a copper-based yarn. A plurality of fibers are obtained by preparing a slurry of polymer mixed with water insoluble nanoparticles of electrolytic copper and extruding the slurry through a spinneret that includes a plurality of holes. The holes of the spinneret are configured to impart a generally "X"-shaped cross-section to each of the plurality of fibers. The plurality of fibers are spun together to form the copper-based yarn.

In another aspect, the present disclosure describes a copper-based yarn obtained from spinning a plurality of fibers. Each of the fibers comprises water insoluble nanoparticles of electrolytic copper embedded in a polymeric component. The cross-section of each fiber is adapted to be generally "X"-shaped.

In yet another aspect, the present disclosure describes a fabric obtained from knitting one or more copper-based yarns with one or more synthetic or natural yarns. The copper-based yarns are obtained from spinning a plurality of fibers. Each of the fibers comprises water insoluble nanoparticles of electrolytic copper embedded in a polymeric component. The cross-section of each fiber is adapted to be generally "X"-shaped.

In yet another aspect, the present disclosure describes a method of making an antimicrobial fabric. The antimicrobial fabric is formed by combining two or more strands of copper-based yarns with each other. The copper-based yarns are obtained from spinning a plurality of fibers. Each of the fibers comprises water insoluble nanoparticles of electrolytic copper embedded in a polymeric component. The cross-section of each fiber is adapted to be generally "X"-shaped.

In yet another aspect, the present disclosure describes a method of making an antimicrobial fabric. The antimicrobial fabric is formed by knitting or weaving one or more copper-based yarns with one or more synthetic or natural fiber yarns. The copper-based yarns are obtained from spinning a plurality of fibers. Each of the fibers comprises water insoluble nanoparticles of electrolytic copper embedded in a polymeric component. The cross-section of each fiber is adapted to be generally "X"-shaped.

Other example embodiments of the present disclosure will be apparent to those of ordinary skill in the art from a review of the following detailed descriptions in conjunction with the drawings.

Figure 1A:
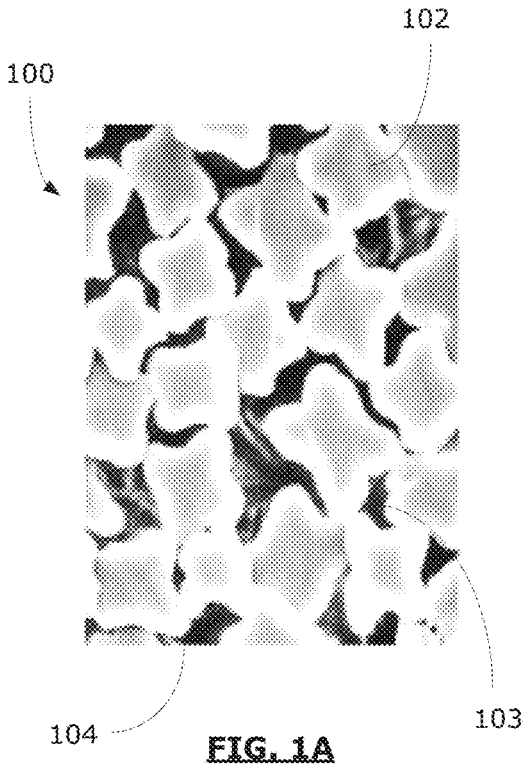
FIG. 1A is an electron microscope photograph showing copper-based fibers having generally "X"-shaped cross-sections and a yarn containing the same, in accordance with example embodiments of the present disclosure.

Reference is now made to FIG. 1A, which is an electron microscope photograph 100 showing cross-sections of copper-based fibers 102 and a copper-based yarn 104 containing the same, in accordance with example embodiments of the present disclosure. The fibers 102 comprise nanoparticles of electrolytic copper embedded in a polymeric component. The electrolytic copper may be manufactured by an electrolysis process and further processed in powder form to grades of differing particle size, surface area, apparent density, etc. The nanoparticles of electrolytic copper powder may be dispersed evenly throughout the polymeric component. In at least some embodiments, the size of each nanoparticle of electrolytic copper powder is in the range of 5 to 50 nanometers. The copper nanoparticles are embedded into fiber of a fabric during a spinning process, as will be described in greater detail below. In particular, copper is not merely added to fabric as a chemical treatment or finish, but is structurally embedded into the fabric proper.

The polymeric component can be made from any synthetic polymer which allows the introduction of nanoparticles of electrolytic copper powder into its liquid slurry state. In some embodiments, the polymeric component may comprise a polyamide, such as nylon. In some other embodiments, the polymeric component may comprise polyester.

Figure 1B:
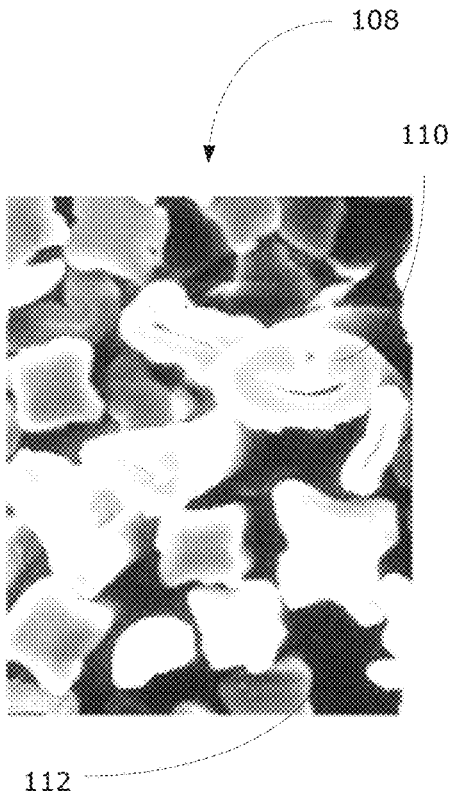
FIG. 1B is an electron microscope photograph showing fibers which do not generally have "X"-shaped cross-sections and a yarn containing the same.

Each of the fibers 102 has a generally "X"-shaped cross-section. This cross-sectional shape of each fiber 102 may facilitate moisture transport in the fiber assembly of copper-based yarn 104. More specifically, the "X"-shape of the cross-section of each fiber 102 may lead to increased wicking ability, producing high wicking and quick drying effects. In particular, each fiber filament may become hydrophilic, absorbing water faster and spreading it over a larger area, thereby increasing contact with air and resulting in reduced drying time. Furthermore, when compared with fibers having generally rounded or circular cross-sections, the "X"-shape cross-section of the fibers 102 may cause larger gaps to be formed between individual strands of yarn. The "X"-shape cross-section of fibers shown in FIG. 1A may facilitate a tighter "fit" between neighbouring fibers when compared to fibers, shown in FIG. 1B, having irregular cross-sectional shape. For example, a gap 103 between neighbouring fibers 102 of FIG. 1A may be smaller than gaps 112 between neighbouring fibers 110 of FIG. 1B. This tighter "fit" may, in turn, allow same or similar strength to be achieved by thinner yarns. The copper-based yarns thus obtained may feel smoother than ordinary high-twist yarn, and may also provide greater resistance to wrinkling and/or pilling. Gaps defined by the cross-sectional shape of fibers may help to minimize contact with skin, adding to comfort and making fabric produced from these fibers lighter than regular nylon fabric of similar thickness.

The copper-based yarn 104 can be weaved into fabric for making garments or different types of textile products such as compression wear, compression sleeves, gloves, and socks. In particular, the copper-based yarn 104 may be used in both knit (e.g. polos, turtlenecks, fleece, etc.) and woven (shirts, pants, windproof outerwear, etc.) fabric. The copper-based yarn 104 can be combined with other polymeric materials (e.g. fibers, yarns) to produce fabric having various different compositions. In some embodiments, a fabric may be obtained by knitting one or more copper-based yarns 104 with other synthetic yarns. For example, copper-based yarns 104 may be knitted with yarns comprising nylon and/or spandex fibers. The copper content of such fabric may range between 1500 and 2000 parts-per-million (ppm), and copper and nylon combined may constitute between 70% and 90%, by weight, of the fabric. For example, the copper and nylon may make up approximately 88%, by weight, of the copper-based fiber. In some embodiments, a fabric may be obtained by weaving one or more copper-based yarns 104 with other synthetic yarns. For example, copper-based yarns 104 may be weaved with yarns comprising polyester, spandex, and/or cotton.

The various types of fabrics obtained using copper-based yarns 104 may provide antibacterial protection by, among other potential benefits, allowing for quick drying of perspiration and effective inhibition of microbial growth. In some cases, a fabric produced from the copper-based yarn 104 may form the interior wicking surface of an apparel. In at least some embodiments, the copper-based fiber may account for more than 5% of the total weight of the obtained fabric. Furthermore, at least some fabrics which may be obtained using the copper-based yarns of the present disclosure may provide the additional benefit of relatively high UV protection.

Figure 2:
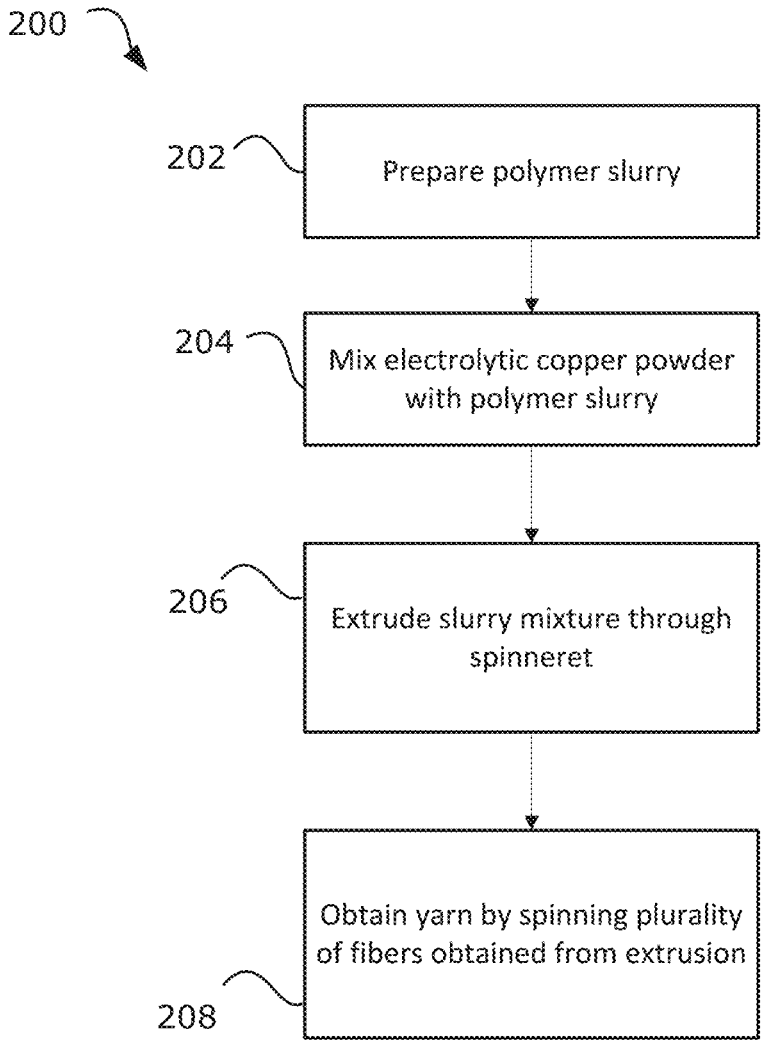
FIG. 2 shows, in flowchart form, an example method of making a copper-based yarn, in accordance with example embodiments of the present disclosure.

Reference is now made to FIG. 2, which shows, in flowchart form, an example method 200 of making a copper-based yarn, in accordance with example embodiments of the present disclosure. The method 200 provides a procedure for embedding copper nanoparticles in polymeric yarns. More specifically, antimicrobial yarns spun from fibers containing electrolytic copper may be produced by method 200.

In operation 202, a slurry of polymer is prepared. The slurry is prepared from a polymer, such as a polyamide (e.g. nylon) or polyester. In at least some embodiments, the slurry may be a polymer solution or a polymer melt. For example, a crystalline polymer can be heated to an appropriate melting point temperature, which may range from 120° C. to 280° C. In particular, the slurry may be prepared at a temperature of at least 200° C. (for example, approximately 220° C. for nylon 6 and approximately 265° C. for nylon 6×6). In some embodiments, the slurry may be prepared at a temperature of approximately 210° C.

In operation 204, the slurry is mixed with water insoluble nanoparticles of electrolytic copper. In at least some embodiments, the electrolytic copper is in powder form. The size of each nanoparticle of electrolytic copper may be in the range of 5 to 50 nanometers. The electrolytic copper powder may be added to the polymer slurry and allowed to spread evenly through the slurry. The slurry and electrolytic copper powder may be mixed together in a single container. For example, in some embodiments, two separate hoppers containing a polymer slurry and electrolytic copper powder, respectively, may feed into a single mixing bath.

In operation 206, a spinneret is used to extrude the heated slurry mixture to form fibers. In particular, the polymer mixture is pushed through a plurality of holes defined on a spinneret, and strands of fiber are formed as the polymer is cooled. The holes are configured to impart a generally "X"-shaped cross-section to each of the plurality of fibers that are obtained from the extrusion. In some embodiments, the holes of the spinneret may themselves have "X"-shaped cross-sections. The fibers may also be drawn, either while the polymer is solidifying or after it has completely cooled, to increase strength and orientation. In some embodiments, the fibers may be drawn at between 20% and 40% of the known tensile strength of the fibers. For example, a fiber may be drawn at 30% of tensile strength or breaking point of the fiber. In some embodiments, the fibers may be drawn at a temperature of at least 120° C. The fibers generally have weak electrical conductivity. For example, the electrical resistivity of the copper-based fiber may be no greater than $10^{-7}$ Ω·cm, at 20° C. and 65% relative humidity.

In operation 208, the fibers are spun together to form an antimicrobial yarn. In particular, a plurality of fiber strands are twisted or grouped together to make a cohesive thread. One or more strands of the copper-based, antimicrobial yarn may be combined (e.g. by weaving, knitting, etc.) (in a subsequent step or method) with each other or combined with other natural or synthetic yarns to form various different fabrics. Examples of such fabrics are described below.

Example Fabric 1: Copper Compression Fabric

A plurality of synthetic yarns comprising nylon and spandex may be knitted together with a copper-based yarn of the present disclosure, to form a copper compression fabric. In at least some embodiments, the synthetic yarns may include an S-twist yarn of nylon and spandex and Z-twist yarn of nylon and spandex. For example, a 70D/72F S-twist yarn of nylon 6×6 can be knitted with a 40D spandex yarn, and a 70D/48F Z-twist nylon 6×6 can be knitted with a 40D spandex yarn. The S-twist yarn and the Z-twist yarn may then be knitted with a copper-based yarn, in particular, a 20D/7F copper nylon yarn produced according to embodiments of the present disclosure. The spandex yarns may usefully provide compression and/or elastic effects to the resulting fabric. The copper content of the resulting fabric may be greater than 1500 ppm. In some embodiments, the copper content of the fabric may be less than 2000 ppm. In another example of a copper compression fabric, one or more copper-based nylon yarns may be combined with spandex yarns. Details of a sample of such fabric is provided in table 1.

TABLE 1

| | |
|---|---|
| Fabric Content | 88% copper-nylon; 12% spandex |
| Fabric Weight | 170 gsm |
| Fabric Width | 155 cm |

A controlled antimicrobial activity test performed on the sample fabric after machine washing the sample 40 times indicated that the sample retained the ability to significantly reduce the number of bacteria that makes contact with the fabric. Furthermore, a UV test, conducted under the conditions of the standard AS/NZS4399, showed that the sample has an ultraviolet protection factor (UPF) of 20+. In particular, the sample fabric provides reasonably high UV protection without any added coating of UV protection chemicals.

It will be understood that other combinations of nylon/spandex yarns may be knitted together with yarn or yarns spun from fibers containing electrolytic copper in making various compression fabrics.

Example Fabric 2: Copper Woven Twill Fabric

A plurality of natural and/or synthetic yarns comprising polyester, cotton, and spandex may be weaved together with a copper-based yarn of the present disclosure, to form a twill fabric. In at least some embodiments, the synthetic yarns may include one or more polyester yarns weaved together with spandex yarns. For example, a combination of two 60s polyester yarns can be weaved together with a 40D spandex yarn. This synthetic yarn may be weaved together with a yarn comprising a combination of two 60s copper polyester yarn and a 40D spandex yarn, where the copper polyester yarn is produced according to embodiments of the present disclosure. The copper content of the resulting fabric may be greater than or approximately equal to 700 ppm. In some embodiments, one or more copper-based polyester yarns may be combined with one or more of cotton yarns, spandex yarns and polyester yarns. Details of a sample of such fabric is provided in table 2.

TABLE 2

| | |
|---|---|
| Fabric Content | 52% cotton; 45% copper-polyester; 3% spandex |
| Fabric Weight | 170 gsm |
| Fabric Width | 57/58 inches |
| Density | 135 × 75 threads per inch |

A controlled antimicrobial activity test performed on the sample fabric after machine washing the sample 40 times indicated that the sample retained the ability to significantly reduce the number of bacteria that makes contact with the fabric.

It will be understood that other combinations of cotton, polyester and/or spandex yarns may be weaved together with yarn or yarns spun from fibers containing electrolytic copper in making various compression fabrics. Such fabrics may possess the useful property of being colorable.

Example Fabric 3: Copper Ripstop Fabric

A plurality of polyester yarns may be weaved together with a copper-based yarn of the present disclosure, to form a ripstop fabric. In at least some embodiments, a 300D polyester yarn may be weaved together with four 60s copper polyester yarns, where the copper polyester yarns are produced according to embodiments of the present disclosure. The fabric 3 may additionally be treated with a cuprous chloride solution. In some embodiments, one or more copper-based polyester yarns may be combined with one or more of cotton yarns and polyester yarns. Details of a sample of such fabric is provided in table 3.

TABLE 3

| | |
|---|---|
| Fabric Content | 60% cotton; 40% copper-polyester |
| Fabric Weight | 260 gsm |
| Fabric Width | 57/58 inches |
| Density | 102 × 66 threads per inch |

Example embodiments of fabric 3 may possess the useful properties of being durable, antibacterial and colorable.

The various embodiments presented above are merely examples and are in no way meant to limit the scope of this application. Variations of the innovations described herein will be apparent to persons of ordinary skill in the art, such variations being within the intended scope of the present application. In particular, features from one or more of the above-described example embodiments may be selected to create alternative example embodiments including a sub-combination of features which may not be explicitly described above. In addition, features from one or more of the above-described example embodiments may be selected and combined to create alternative example embodiments including a combination of features which may not be explicitly described above. Features suitable for such combinations and sub-combinations would be readily apparent to persons skilled in the art upon review of the present application as a whole. The subject matter described herein and in the recited claims intends to cover and embrace all suitable changes in technology.

The invention claimed is:

1. A compression fabric obtained from knitting one or more copper-based yarns together with one or more synthetic fiber yarns, wherein the one or more copper-based yarns are obtained from spinning a plurality of fibers that include water insoluble nanoparticles of electrolytic copper embedded in a nylon polymeric component, each of the plurality of fibers being formed with a generally X-shaped cross-section; and the one or more synthetic fiber yarns include an S-twist yarn of nylon and spandex and a Z-twist yarn of nylon and spandex, wherein content of copper in the fabric is at least 1500 parts-per-million.

2. The compression fabric of claim 1, wherein the fabric comprises between 70% and 90%, by weight, of copper and nylon.

3. The compression fabric of claim 1, wherein a size of each nanoparticle of electrolytic copper is in the range of 5 to 50 nanometers.

4. The compression fabric of claim 1, wherein the one or more synthetic fiber yarns include a 70D/72F S-twist yarn of nylon knitted together with a 40D spandex yarn and a 70D/48F Z-twist yarn of nylon knitted together with a 40D spandex yarn.

5. The compression fabric of claim 1, wherein one or more copper-based yarns comprise 20D/7F nylon yarns.

* * * * *